US010294939B2

(12) United States Patent
Calhoun et al.

(10) Patent No.: US 10,294,939 B2
(45) Date of Patent: May 21, 2019

(54) ANGULAR SYNCHRONIZATION OF STATIONARY AND ORBITING PLATE SCROLL BLADES IN A SCROLL PUMP USING A METALLIC BELLOWS

(71) Applicant: AGILENT TECHNOLOGIES, INC., Santa Clara, CA (US)

(72) Inventors: John Calhoun, Lexington, MA (US); George Galica, Worcester, MA (US); Vannie (Yucong) Lu, Billerica, MA (US); James Pierce, Waltham, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 343 days.

(21) Appl. No.: 15/075,123

(22) Filed: Mar. 19, 2016

(65) Prior Publication Data

US 2016/0201670 A1 Jul. 14, 2016

Related U.S. Application Data

(62) Division of application No. 13/857,490, filed on Apr. 5, 2013, now Pat. No. 9,328,730.

(51) Int. Cl.

| | |
|---|---|
| ***F04C 2/02*** | (2006.01) |
| ***F04C 18/02*** | (2006.01) |
| ***F01C 17/06*** | (2006.01) |

(52) U.S. Cl.

CPC ..... *F04C 18/0269* (2013.01); *F01C 17/06* (2013.01); *F04C 2/025* (2013.01);
(Continued)

(58) Field of Classification Search

CPC ..... F16B 19/06; F16B 5/04; B29C 70/028; B29C 70/78; B29C 66/1122;
(Continued)

(56) References Cited

U.S. PATENT DOCUMENTS

| | | | | |
|---|---|---|---|---|
| 1,376,291 A | | 4/1921 | Rolkerr | |
| 3,802,809 A | * | 4/1974 | Vulliez | F04C 18/0215 418/5 |

(Continued)

FOREIGN PATENT DOCUMENTS

| | | |
|---|---|---|
| EP | 1085211 A2 | 3/2001 |
| GB | 2406616 | 4/2005 |

(Continued)

OTHER PUBLICATIONS

Machine Translation of JP2010001858, Jan. 7, 2010.

(Continued)

*Primary Examiner* — Ryan J. Walters
*Assistant Examiner* — Lawrence Averick

(57) ABSTRACT

Parts of a pump head of a scroll pump facilitate an assembly process in which the stationary and orbiting scroll blades of the pump are angularly aligned or synchronized with one another. A metallic bellows of the pump head provides a primary means of synchronizing the stationary and orbiting scroll blades. The assembly process may be carried out using a fixture configured to be mountable to an assemblage including the bellows and the orbiting plate scroll. The fixture has a reference feature, and the orbiting plate scroll or the frame has another reference feature that can be aligned with the reference feature of the fixture, in the circumferential direction of the bellows, during the course of the assembly process.

11 Claims, 14 Drawing Sheets

(52) U.S. Cl.
CPC .... *F04C 18/0215* (2013.01); *F04C 2230/603* (2013.01); *Y10T 29/4924* (2015.01)

(58) Field of Classification Search
CPC ..... B29C 66/742; B29C 66/73751; B29C 65/562; B29C 66/45; B29C 65/564; B29C 66/02242; B29C 65/64; B29C 66/721; B29C 66/7422; B29L 2031/3076; F04C 18/0269; F04C 2/025; F04C 17/06; F04C 18/0215; F04C 2230/603; Y10T 29/4924
USPC ..... 418/55.1–55.5
See application file for complete search history.

(56) References Cited

U.S. PATENT DOCUMENTS 3,817,664 A 6/1974 Bennett et al.
4,460,321 A 7/1984 Terauchi
4,604,039 A 8/1986 Terauchi
4,731,000 A 3/1988 Haag
4,795,323 A 1/1989 Lessie
4,927,340 A 5/1990 McCullough
5,051,075 A 9/1991 Young
5,147,192 A 9/1992 Suzuki et al.
5,149,255 A 9/1992 Young
5,178,526 A 1/1993 Galante et al.
5,328,341 A 7/1994 Forni
5,342,186 A 8/1994 Swain
5,951,268 A * 9/1999 Pottier ..... F01C 17/00 418/5
5,951,272 A 9/1999 Fukuhara et al.
6,022,202 A 2/2000 Pottier et al.
6,050,793 A 4/2000 Barthod et al.
6,364,644 B1 4/2002 Saito
6,461,129 B2 10/2002 Liu
6,764,288 B1 * 7/2004 Liepert ..... F04C 18/0261 418/5
6,884,047 B1 * 4/2005 Liepert ..... F01C 21/02 418/5
7,244,113 B2 * 7/2007 Liepert ..... F04C 27/005 415/216.1
7,261,528 B2 * 8/2007 Liepert ..... F04C 29/0057 418/55.1
7,442,016 B2 * 10/2008 Dovey ..... F01C 17/00 418/55.1
7,654,805 B2 2/2010 Ishikawa
8,323,006 B2 * 12/2012 Schofield ..... F04C 18/0215 417/410.5
8,591,210 B2 * 11/2013 Collie ..... F01C 21/102 418/1
2002/0006343 A1 * 1/2002 Barito ..... F04C 23/008 418/55.1
2002/0098100 A1 * 7/2002 Mori ..... F04C 18/0246 418/55.2
2002/0119062 A1 8/2002 Liu
2005/0063850 A1 * 3/2005 Liepert ..... F04C 18/0215 418/55.4
2005/0084403 A1 * 4/2005 Liepert ..... F01C 21/02 418/55.1
2005/0220647 A1 * 10/2005 Liepert ..... F04C 29/0057 418/55.3
2006/0051225 A1 * 3/2006 Dovey ..... F01C 17/00 418/55.1
2006/0078450 A1 * 4/2006 Liepert ..... F04C 27/005 418/55.2
2007/0110605 A1 5/2007 Masuda
2008/0124236 A1 * 5/2008 Schofield ..... F04C 18/0215 418/55.1
2009/0180909 A1 7/2009 Schofield et al.
2010/0233002 A1 * 9/2010 Collie ..... F01C 21/102 418/55.5
2011/0076172 A1 * 3/2011 Calhoun ..... F04C 18/0215 418/1

FOREIGN PATENT DOCUMENTS

JP 61123789 6/1986
JP 2010001858 1/2010
WO 2004072483 A1 8/2004
WO 2005045249 A1 5/2005
WO 2006061559 A1 6/2006

OTHER PUBLICATIONS

Office action dated Dec. 1, 2015 in co-pending U.S. Appl. No. 13/798,613.
Office action dated Jan. 2, 2015 in co-pending U.S. Appl. No. 13/798,613.
Office action dated Jun. 18, 2014 in Chinese Application No. 201420064991.5 (Unofficial/non-certified translation provided by foreign agent included).
Office action dated Jun. 19, 2015 in co-pending U.S. Appl. No. 13/798,613.
Quayle Office action dated Nov. 5, 2015 in co-pending U.S. Appl. No. 14/094,683.
Search Report dated Sep. 16, 2014 in U.K.Application No. GB1400495.6.
Search Report dated Sep. 30, 2014 in U.K.Application No.GB1402163.8.
Office action dated Jun. 18, 2014 in Chinese Application No. 201420098646.3. (Unofficial/non-certified translation provided by foreign agent included).
Search Report dated Oct. 31, 2014 in UK Application No. GB1403800.4.

* cited by examiner

ANGULAR SYNCHRONIZATION OF STATIONARY AND ORBITING PLATE SCROLL BLADES IN A SCROLL PUMP USING A METALLIC BELLOWS

RELATED APPLICATIONS

This application is a divisional of and claims priority from U.S. patent application Ser. No. 13/857,490, filed Apr. 5, 2013, which is incorporated herein by reference in its entirety.

BACKGROUND OF THE INVENTION

1. Field of the Invention

The present invention relates to a scroll pump having a pump head assembly that includes a stationary plate scroll and an orbiting plate scroll having respective scroll blades that are angularly synchronized with one another. In particular, the present invention relates to an appliance for and to a method of assembling parts of the scroll pump such that the stationary and orbiting scroll blades of the pump head assembly will be angularly synchronized.

2. Description of the Related Art

A scroll pump is a type of pump that includes a stationary plate scroll having a spiral stationary scroll blade, and an orbiting plate scroll having a spiral orbiting scroll blade. The stationary and orbiting scroll blades are nested with a clearance and predetermined relative angular positioning such that a pocket (or pockets) is delimited by and between the blades. The scroll pump also has a frame to which the stationary plate scroll is fixed and an eccentric drive mechanism supported by the frame. These parts generally are part of an assembly that may be referred to as a pump head assembly of the scroll pump.

The orbiting scroll plate and hence, the orbiting scroll blade, is coupled to and driven by the eccentric driving mechanism so as to orbit about a longitudinal axis of the pump head assembly passing through the axial center of the stationary scroll blade. The volume of the pocket(s) delimited by the scroll blades of the pump is varied as the orbiting scroll blade moves relative to the stationary scroll blade. The orbiting motion of the orbiting scroll blade also causes the pocket(s) to move within the pump head assembly such that the pocket(s) is selectively placed in open communication with an inlet and outlet of the scroll pump.

In an example of such a scroll pump, the motion of the orbiting scroll blade relative to the stationary scroll blade causes a pocket sealed off from the outlet of the pump and in open communication with the inlet of the pump to expand. Accordingly, fluid is drawn into the pocket through the inlet. Then the pocket is moved to a position at which it is sealed off from the inlet of the pump and is in open communication with the outlet of the pump, and at the same time the pocket is contracted. Thus, the fluid in the pocket is compressed and thereby discharged through the outlet of the pump.

In the case of a vacuum-type of scroll pump, the inlet of the pump is connected to a chamber that is to be evacuated. Conversely, in the case of a compressor-type of scroll pump, the outlet of the pump is connected to a chamber that is to be supplied with pressurized fluid by the pump.

In any case, the predetermined angular position of the orbiting scroll blade relative to the stationary scroll blade must be provided and maintained if the above-described intake and discharge operations are to be executed satisfactorily by the scroll pump. More specifically, the orbiting plate scroll must maintain a certain angular synchronization with the stationary plate scroll if seals created by and between the stationary and orbiting scroll blades are to form the pocket(s) stably, cause the volume of the pocket(s) to vary appropriately and effectively cause the pocket(s) to move through the pump head assembly with the timing required relative to the inlet and outlet of the pump. To this end, the orbiting plate scroll must not rotate in excess of a certain amount about its own central axis while it orbits about the longitudinal axis of the pump head assembly.

SUMMARY OF THE INVENTION

It is a general object of the present invention to provide a pump head assembly of a scroll pump whose stationary and orbiting scroll blades are angularly synchronized.

It is another object of the present invention to provide parts of a scroll pump, and an appliance for use in assembling respective ones of the parts in such a way that the stationary and orbiting scroll blades of the plate scrolls can be easily angularly synchronized with one another.

It is still another object of the present invention to provide a pump head assembly of a scroll pump having parts that facilitate a predetermined angular positioning of an orbiting scroll blade relative to a stationary scroll blade during a process of assembling the parts to one another.

It is still another object of the present invention to provide a method of assembling parts of a pump head of a scroll pump that facilitates a predetermined angular positioning of an orbiting scroll blade relative to a stationary scroll blade of the pump.

It is another object of the present invention to provide a method of assembling a pump head of a scroll pump that facilitates the connecting of a bellows of the pump head to an orbiting plate scroll and to a frame of the pump head.

It is still another object of the present invention to provide a scroll pump having a pump head that includes a stationary plate scroll, a tip seal seated in the tip of the scroll blade of the stationary plate scroll, an orbiting plate scroll including a plate having a tip-seal receiving surface against which the tip seal bears, a bellows, and fasteners that fasten an end of the bellows to the orbiting plate scroll without interrupting the surface of the orbiting plate scroll which receives the tip seal.

Likewise, it is an object of the present invention to provide a method of assembling a pump head of a scroll pump by which a bellows of the pump head can be connected to an orbiting plate scroll of the pump without the need for a break in a tip-seal receiving surface of the orbiting plate scroll.

Still other objects of the present invention are to provide a scroll pump, and a method of assembling a pump head of a scroll pump, in which bearings of the eccentric drive mechanism of the pump head are/can be pre-loaded without the need for a break in a tip-seal receiving surface of the orbiting plate scroll.

According to one aspect of the inventive concept, there is provided a combination of pump head parts of a scroll pump and an appliance for use in assembling the pump head parts. The parts include a frame, an orbiting plate scroll having a front side and a back side and comprising an orbiting scroll blade at its front side, an annular metallic bellows having first and second ends, a stationary plate scroll having a front side and a back side and comprising a stationary scroll blade at its front side, and fasteners. The appliance includes a fixture adapted for use with respective ones of the parts. The fixture and the fasteners constitute assembly parts by which the stationary and orbiting scroll blades are angularly synchronized with one another during an assembly process in which the bellows is fixed to the orbiting plate scroll and to the frame, and the stationary plate scroll is fixed to the frame. To this end, the fixture has a reference feature, and the fasteners are for fastening the bellows at the first end thereof to the orbiting plate scroll, the bellows at the second end thereof to the frame, and the stationary plate scroll to the frame, respectively. The fixture is configured so as to be mountable to an assemblage comprising the bellows and the orbiting plate scroll. In addition, either the orbiting plate scroll or the frame has another reference feature that can be aligned with the reference feature of the fixture, in the circumferential direction of the bellows, during the course of the assembly process.

According to another aspect of the present invention, there is provided a pump head of a scroll pump which includes a frame, an orbiting plate scroll having an orbiting scroll blade, an eccentric driving mechanism supported by the frame and to which the orbiting plate scroll is coupled, a stationary plate scroll fixed to the frame and having a stationary scroll blade nested with the annular scroll blade, an annular metallic bellows having first and second ends, fasteners that fix the bellows at the first end thereof to orbiting plate scroll, the bellows at the second end thereof to the frame, and the stationary plate scroll to the frame, and in which one of the orbiting plate scroll and the frame has a curved mounting feature and a reference feature. The curved mounting feature is juxtaposed in the axial direction of the pump head with one of the flanges of the bellows and facilitates an angular positioning of the bellows in an assemblage during the course of the assembly process. To this end, the curved feature having a radius of curvature radiating from a central longitudinal axis of the pump head. The reference means is a reference feature, such as a precision-machined feature, that is used to synchronize the stationary and orbiting scroll blades in the assembly process.

According to another aspect of the present invention, there is provided a method of assembling parts of a pump head of a scroll pump, which includes placing a first end of a metallic bellows against a back surface of a plate of an orbiting plate scroll having an orbiting scroll blade protruding from a front surface of the plate, fixing the first end of the metallic bellows to the orbiting plate scroll, placing a second end of the metallic bellows against an inner surface of a frame, performing an angular alignment process of establishing a predetermined angular alignment between the frame and the orbiting plate scroll, subsequently fixing a second end of the bellows to the frame, subsequently fixing a stationary plate scroll of the pump to the frame in a predetermined angular alignment with the frame and such that a stationary scroll blade of the stationary plate scroll faces the orbiting scroll blade in a radial direction, and in which the metallic bellows is fixed to the orbiting plate scroll by inserting fasteners into the plate of the orbiting plate scroll from the back surface of the plate, the metallic bellows is fixed to the frame by inserting fasteners into the frame from an outer surface of the frame opposite the inner surface, and the angular alignment process and the fastening of the stationary plate scroll to the frame angularly synchronizes the stationary and orbiting scroll blades with one another.

According to still another aspect of the inventive concept, there is provided a method of assembling parts of a pump head of a scroll pump, in which a first end of a metallic bellows is placed against a back side of an orbiting plate scroll having an orbiting scroll blade at its front side, and a reference feature, a second end of the metallic bellows is placed against a frame, a fixture having a reference feature is mounted to an assemblage comprising the bellows and the orbiting plate scroll, and an angular alignment process is performed. The angular alignment process entails rotating the bellows, with the fixture mounted to the assemblage, until the reference feature of the fixture aligns in the circumferential direction of the bellows with another reference feature provided on one of the orbiting plate scroll and the frame. The fixture is removed from the assemblage after the angular alignment process has been performed. In addition, the bellows is fixed at the first end thereof to the orbiting plate scroll and at the second end thereof to the frame at respective times during the course of the assembly process. In particular, the bellows is fixed to either the orbiting plate scroll or the frame before the angular alignment process is performed, and is fixed to the other of the orbiting plate scroll after the angular alignment process has been performed. Subsequently, a stationary plate scroll, having a stationary scroll blade, is fixed to the frame in a predetermined angular alignment with the frame and such that the stationary scroll blade faces the orbiting scroll blade in a radial direction, i.e., such that the stationary and orbiting scroll blades are nested.

BRIEF DESCRIPTION OF THE DRAWINGS

These and other objects, features and advantages of the present invention will be better understood from the detailed description of the preferred embodiments thereof that follows with reference to the accompanying drawings, in which:

FIGS. 3A-3G are schematic diagrams illustrating steps in the first embodiment of a method of assembling respective parts of the pump head assembly according to the present invention, and in which FIG. 3A is schematic longitudinal sectional view of an assemblage of parts of the pump head on a jig during the process, FIG. 3B is a sectional view taken along line IIIB-IIIB' of FIG. 3A, FIG. 3C is a schematic longitudinal sectional view of the assemblage in which a fixture has been mounted to the bellows of the assemblage, FIG. 3D is a sectional view taken along line IIID-IIID' of FIG. 3C during one part of the process, FIG. 3E is another sectional view taken along line IIID-IIID' of FIG. 3C but during another part of the process, FIG. 3F is schematic longitudinal sectional view of an assemblage in which the bellows has been fixed to the orbiting plate scroll; and FIG. 3G is a view similar to that of FIG. 3C but showing another version of a fixture that may be used;

FIGS. 5A-5F are schematic diagrams illustrating steps in the second embodiment of a method of assembling respective parts of the pump head assembly according to the present invention, in which FIG. 5A is schematic longitudinal sectional view of an assemblage of parts of the pump head during the process, FIG. 5B is a sectional view taken along line VB-VB' of FIG. 5A, FIG. 5C is a sectional view taken along line VC-VC' of FIG. 3C, FIG. 5D is schematic longitudinal sectional view of the assemblage in which a fixture has been mounted to the orbiting plate scroll of the assemblage, FIG. 5E is a plan view of the assemblage of FIG. 5D, and FIG. 5F is schematic longitudinal sectional view of an assemblage in which the bellows has been fixed to the frame;

DETAILED DESCRIPTION OF THE PREFERRED EMBODIMENTS

Figure 1:
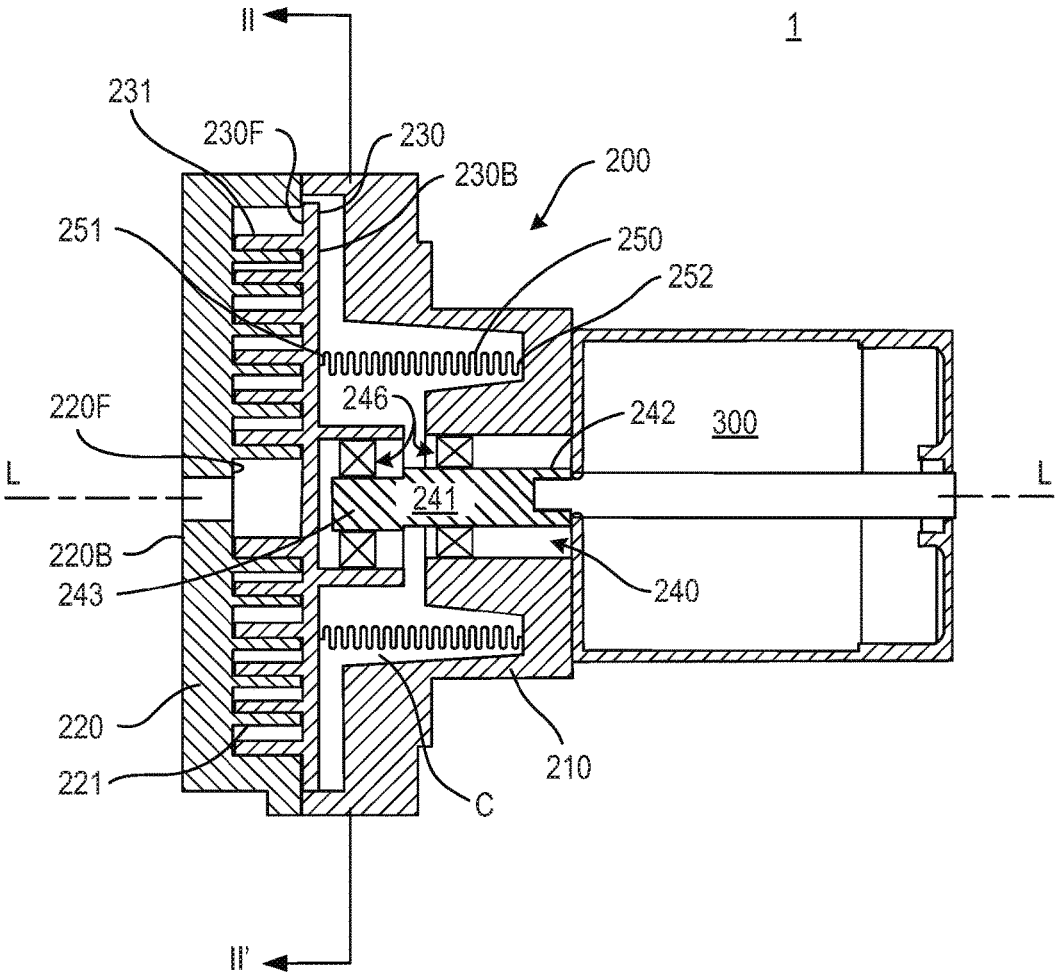
FIG. 1 is a schematic longitudinal sectional view of one version of a scroll pump to which the present invention is applied.

Various embodiments and examples of embodiments of the inventive concept will be described more fully hereinafter with reference to the accompanying drawings. In the drawings, the sizes and relative sizes of elements may be exaggerated for clarity. Likewise, the shapes of elements may be exaggerated and/or simplified for clarity and ease of understanding. Also, like numerals and reference characters are used to designate like elements throughout the drawings.

Furthermore, spatially relative terms, such as "front" and "back" are used to describe an element's relationship to another element(s) as illustrated in the figures. Thus, the spatially relative terms may apply to orientations in use which differ from the orientation depicted in the figures. Obviously, though, all such spatially relative terms refer to the orientation shown in the drawings for ease of description and are not necessarily limiting as apparatus according to the invention can assume orientations different than those illustrated in the drawings when in use.

Other terminology used herein for the purpose of describing particular examples or embodiments of the inventive concept is to be taken in context. For example, the terms "comprises" or "comprising" when used in this specification indicates the presence of stated features or processes but does not preclude the presence of additional features or processes. The term "pump" may refer to apparatus that drives, or raises or decreases the pressure of a fluid, etc. The term "fixed" may be used to describe a direct connection of two parts to one another in such a way that the parts cannot move relative to one another or a connection of the parts through the intermediary of one or more additional parts in such a way that the parts cannot move relative to each other. The term "assemblage" may refer to a collection of parts that are set in position against one another regardless of whether the parts are fixed to one another.

Referring now to FIG. 1, a scroll pump 1 to which the present invention may be applied includes a housing (not shown), and a pump head assembly 200 and a motor 300 having a rotary output disposed in the housing. The pump head assembly 200 includes a frame 210, a stationary plate scroll 220, an orbiting plate scroll 230, an eccentric drive mechanism 240, an annular metallic bellows 250, and fasteners (to be described in more detail later on) fixing the stationary plate scroll 220 to the frame 210 and the metallic bellows 250 to both the frame 210 and the orbiting plate scroll 220.

The frame 210 may be one unitary piece, or the frame 210 may comprise several integral parts that are fixed to one another as shown.

The stationary plate scroll 220 is fixed to the frame 210. The stationary plate scroll 220 has a front side 220F and a back side 220B, and comprises a stationary scroll blade 221 at its front side 220F. The orbiting plate scroll 230 has a front side 230F and a back side 230B, and comprises an orbiting scroll blade 231 at its front side 230F. The stationary scroll blade 221 and the orbiting scroll blade 231 are nested with a clearance and predetermined relative angular positioning such that a pocket or pockets is/are delimited by and between the stationary and orbiting scroll blades 221 and 231. In this respect, portions of the scroll blades 221 and 231 need not contact each other to seal the pocket(s). Rather, minute clearances between portions of the scroll blades 221 and 231 may create a seal sufficient for forming a satisfactory pocket(s).

The eccentric drive mechanism 240 includes a drive shaft 241 and bearings 246. In this example, the drive shaft 241 is a crank shaft having a main portion 242 coupled to the motor 300 so as to be rotated by the motor 300 about a longitudinal axis L of the pump 1, and a crank 243 whose central longitudinal axis is offset in a radial direction from the longitudinal axis L. The bearings 246 comprise a plurality of sets of rolling elements.

Also, in this example, the main portion 242 of the crank shaft is supported by the frame 210 via one or more sets of the bearings 246 so as to be rotatable relative to the frame 210. The orbiting plate scroll 230 is mounted to the crank 243 via another set or sets of the bearings 246. Thus, the orbiting plate scroll 230 is carried by crank 243 so as to orbit about the longitudinal axis of the pump when the main shaft 242 is rotated by the motor 300, and the orbiting plate scroll 230 is supported by the crank so as to be rotatable about the central longitudinal axis of the crank 243.

During a normal operation of the pump, a load applied to the orbiting scroll blade 231, due to the fluid being worked on in the pocket(s) defined between the stationary scroll blade 221 and the orbiting scroll blade 231, thus tends to act in such a way as to cause the orbiting plate scroll 230 to rotate about the central longitudinal axis of the crank 243. However, the metallic bellows 250 restrains the orbiting plate scroll 230 in such a way as to allow it to orbit about the longitudinal axis of the pump while inhibiting its rotation about the central longitudinal axis of the crank 243.

More specifically, the metallic bellows 250 has a first end 251 at which the bellows 250 is fixed to the back side 230B of the orbiting plate scroll 230 and a second end 252 at which the bellows 250 is fixed to the frame 210. In this respect, the metallic bellows 250 is radially flexible enough to allow the first end 251 thereof to follow along with the orbiting plate scroll 230 while the second end 252 of the bellows 250 remains fixed to the frame 210. On the other hand, the metallic bellows 250 has a torsional stiffness that prevents the first end 251 of the bellows 250 from rotating significantly about the central longitudinal axis of the bellows 250, i.e., from rotating significantly in its circumferential direction, while the second end 252 of the bellows 250 remains fixed to the frame 210.

In the pump head assembly 200 of the present invention, the specifications of the metallic bellows 250, e.g., the wall thickness, etc., which impart the torsional stiffness to the bellows 250 are designed such that the first end 251 of the bellows 250 will not rotate more than a minimal amount in its circumferential direction under normal loads applied to the orbiting plate scroll 230.

In these respects, the metallic bellows 250 provides and maintains at least in part the angular synchronization of the stationary scroll blade 221 and the orbiting scroll blade 231. Furthermore, not only does the metallic bellows 250 extend between the frame 210 and the back side 230B of the orbiting plate scroll 230, but the metallic bellows 250 also extends around a portion of the crank shaft and the bearings 246 of the eccentric drive mechanism 240. In this way, the bellows 250 may also seal the bearings 246 and bearing surfaces from a space defined between the bellows 250 and the frame 210 in the radial direction and which space may constitute a chamber C, e.g., a vacuum chamber of the pump, through which fluid worked by the pump passes. Accordingly, lubricant employed by the bearings 246 and/or particulate matter generated by the bearings surfaces can be prevented from passing into the chamber C by the bellows 250.

A first embodiment of a method of assembling the pump head assembly 200 will now be described with reference to FIGS. 1, 2 and 3A-3F.

First, the orbiting plate scroll 230 is set on a jig J (FIG. 3A) that prevents the orbiting plate scroll 230 from rotating about its central longitudinal axis, with the back side 230B of the orbiting plate scroll 230 facing up and exposed (S10). To this end, the jig J may have cavity in which the orbiting scroll blade 231 is received, and a portion P that projects upwardly into the cavity and into engagement with the orbiting scroll blade 231 at locations that will prevent the orbiting plate scroll 230 from rotating relative to the jig J. The rotation-preventing portion P of the jig J may be a set of pegs. Alternatively, the rotation-preventing portion P of the jig J may have a shape that is complementary to that of the orbiting scroll blade 231 (or portions thereof) so that the orbiting scroll blade 231 is received snugly in the cavity. Note, however, the first step S10 is optional and the orbiting plate scroll 230 may be merely set on a table top instead.

Figure 3A:
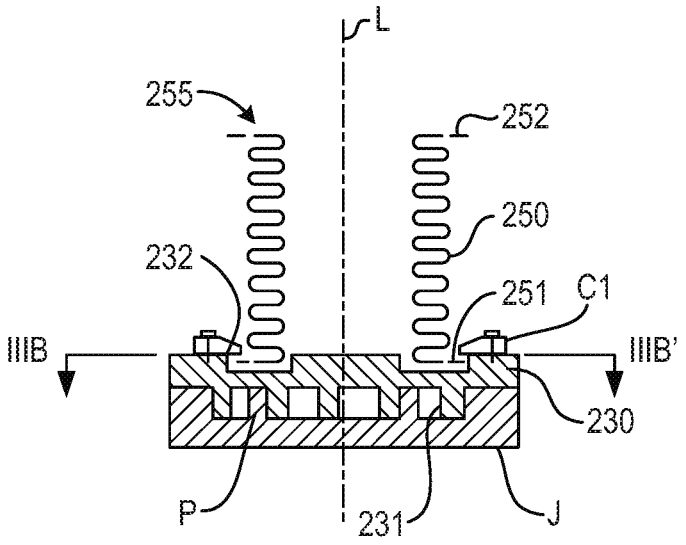
Figure 3B:
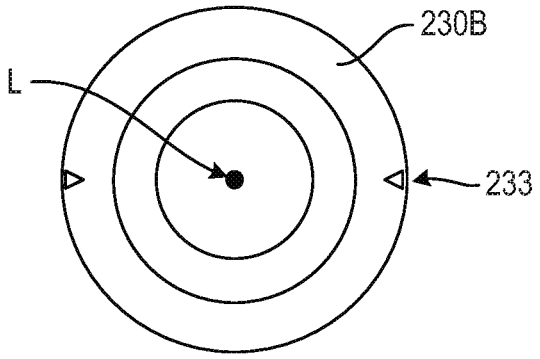

In any case, in this embodiment as shown in FIGS. 3A and 3B, the orbiting plate scroll 230 defines a circular recess 232 and has a reference feature 233 (as represented by the arrow heads) at the back side 230B thereof. The circular recess 232 is preferably annular. The reference feature 233 is preferably a precision-machined feature such as one or more bores in the orbiting plate scroll 230.

Also, at this time, preferably a fastener for fixing the bellows 250 at its first end 251 to the orbiting plate scroll 230 is loosely attached to the orbiting plate scroll 230 such that the bellows 250 is held in place by the fastener but is still movable to some degree until the fastener is tightened. The fastener in this example comprises a clamp Cl that clamps the first end 251 to the back side 230B of the orbiting plate scroll 230. However, the process may proceed without the fastener at this time.

Figure 2:
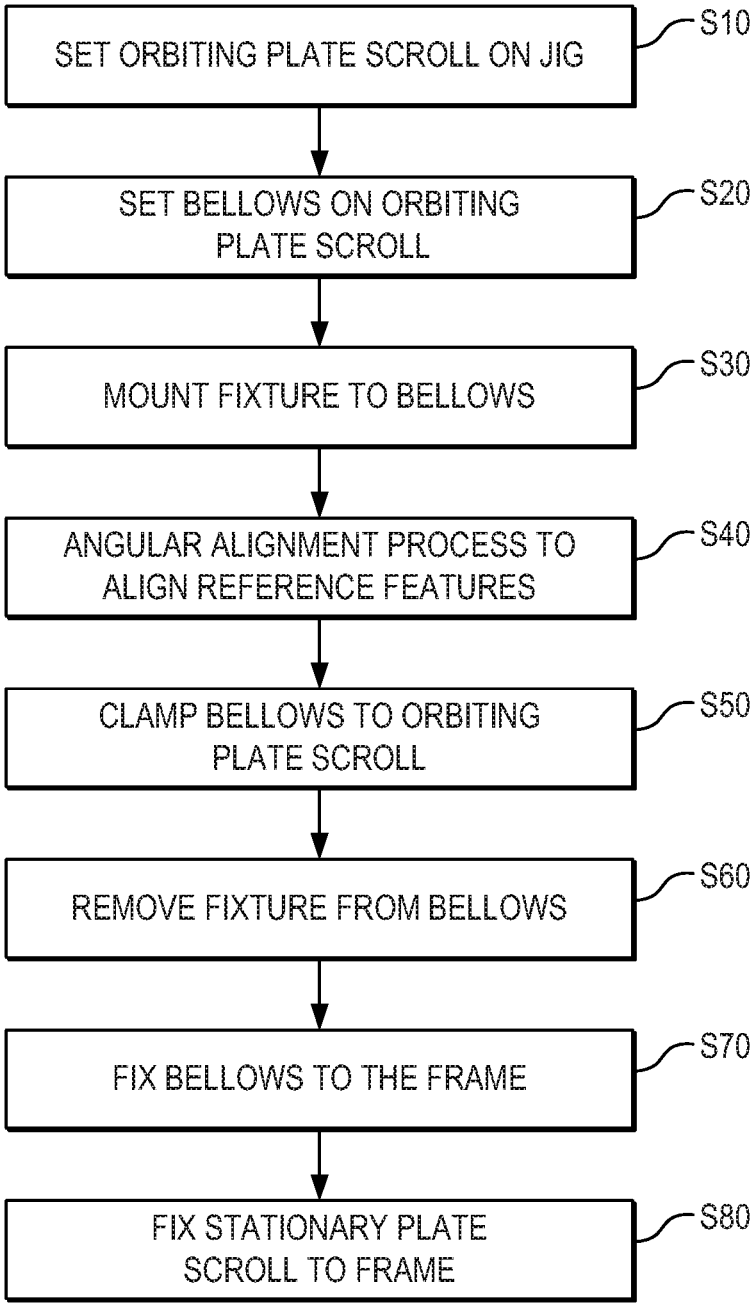
FIG. 2 is a flow chart illustrating a first embodiment of a method of assembling respective parts of the pump head of a scroll pump according to the present invention.

Next, and still referring to FIGS. 2, 3A and 3B, the first end 251 of the metallic bellows 250 is placed against the back side 230B of the orbiting plate scroll 230 while the orbiting plate scroll 230 is on the jig J (S20). In the illustrated example of this embodiment, the first end 251 of the metallic bellows 250 is an annular flange, and the flange is inserted into the circular recess 232 in the back side 230B of the orbiting plate scroll 230. The outer diameter of the annular flange is substantially the same as that of the circular recess 232. In the case in which the circular recess 232 is annular, the inner diameter of the annular flange is also substantially the same as that of the recess 232. At this time, the metallic bellows 250 and the orbiting plate scroll 230 constitute an assemblage. The clamp Cl may also be considered as part of the assemblage and may have an annular clamp body or may comprise a series of individual clamping members distributed in the circumferential direction of the annular flange of the bellows 250.

Figure 3C:
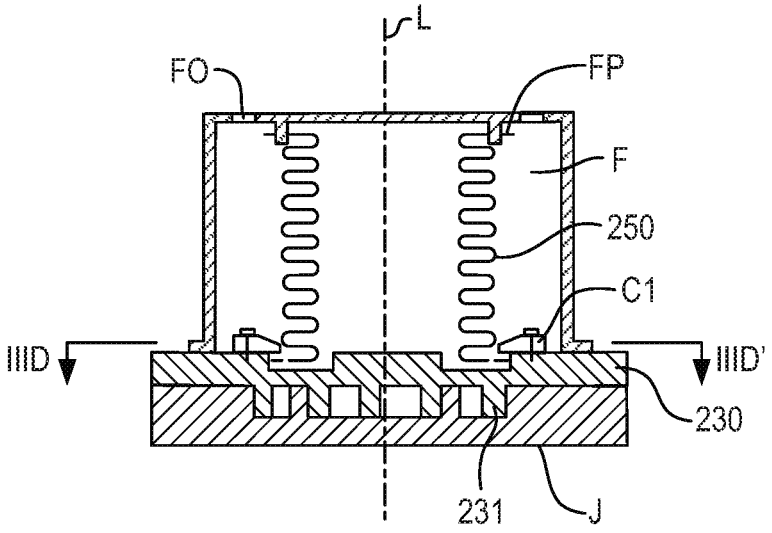
Figure 3D:
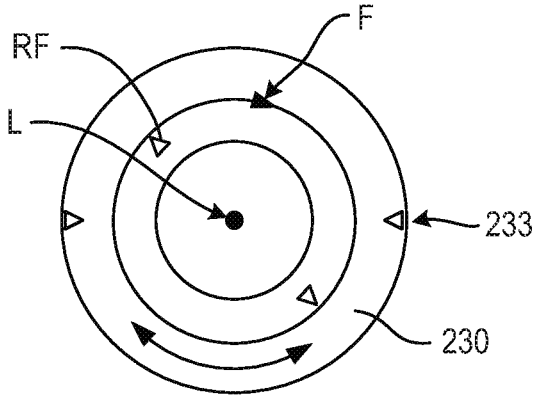

Next, and referring to FIGS. 2, 3C and 3D, a fixture F is mounted to the assemblage by mating respective portions of the fixture F and the second end 252 of the metallic bellows 250 with one another such that the fixture F is mounted to the bellows 250 with a predetermined angular alignment therewith (S30). For example, as shown in FIGS. 3A and 3C, the fixture F has pins FP, and the second end 252 of the metallic bellows 250 is an annular flange having holes 255 (FIG. 3A) therein corresponding to the pins FP, respectively. The holes 255 are preferably through-holes that receive the fasteners used to fix the bellows 250, at the second end 252 thereof, to the frame 210 of the pump head. The fixture F is mounted to the assemblage by respectively inserting the pins FP of the fixture F into holes 255 provided in the second end 252 of the metallic bellows 250.

Also, as mentioned above, preferably, a clamp C1 is loosely attached to the orbiting plate scroll 230 at this time.

Figure 3E:
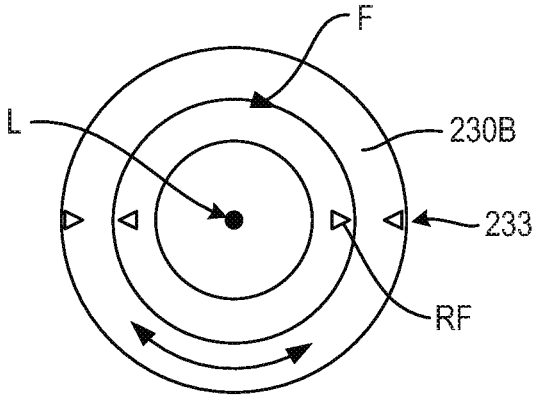

Next, and referring to FIGS. 2, 3D and 3E, an angular alignment process (S40) is performed. The angular alignment process in this embodiment comprises rotating the fixture F mounted to the bellows 250 about the longitudinal axis L relative the orbiting plate scroll 230 (as represented by the double-headed arrow in FIG. 3D) until the reference feature RF of the fixture F aligns, in the circumferential direction of the bellows 250, with the reference feature 233 of the orbiting plate scroll 230. In this process, the bellows 250 is also rotated along with the fixture F due to the mating engagement between the fixture F and the bellows 250 provided by the pins FP of the fixture F, and as allowed for by the circular recess 232 in the back side 230B of the orbiting plate scroll 230 in which the annular flange constituting the first end 251 of the orbiting plate scroll 230 is received.

Because the fixture F is mounted to the bellows 250 with a predetermined angular alignment therewith, the bellows 250 (and more precisely, the set of through-holes in the end 252 of the bellows used to fasten the bellows 250 to the frame 210) assumes a predetermined angular alignment with the orbiting scroll blade 231.

Next, the clamp C1 is tightened to fix the bellows 250 to the orbiting plate scroll 230. For example, the clamp C1 has machine screws threaded to the back side 230B of the orbiting plate scroll 230, and the fixture F has an opening(s) FO axially aligned with the heads of the machine screws of the clamp C1. A tool (e.g., a screwdriver or wrench) used to tighten the machine screws is inserted into the head of the machine screws through the openings FO. Instead of the openings FO, the fixture F may have a skeletal structure that allows the tool to access the clamp C1. Accordingly, the first end 251 of the bellows 250 is fastened to the orbiting plate scroll 230 with the bellows 250 in its predetermined angular alignment with (the blade 231 of) the orbiting scroll blade 231.

Also, at some time during the course of the above-described process, respective components of the eccentric drive mechanism 240 are assembled to the frame 210 and the orbiting plate scroll 230. In particular, bearings 246 and drive shaft 241 are fixed to the orbiting plate scroll 230 before the bellows 250 is set on the orbiting plate scroll 230, i.e., before step S20 or S10. An example of this process will be described later on with respect to an embodiment of the method that does not employ a fixture.

Figure 3F:
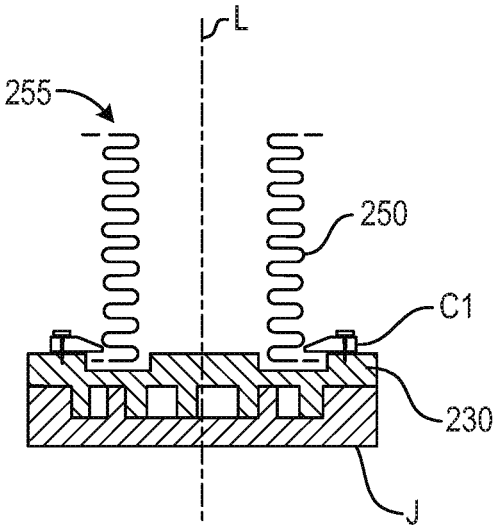
Figure 3G:
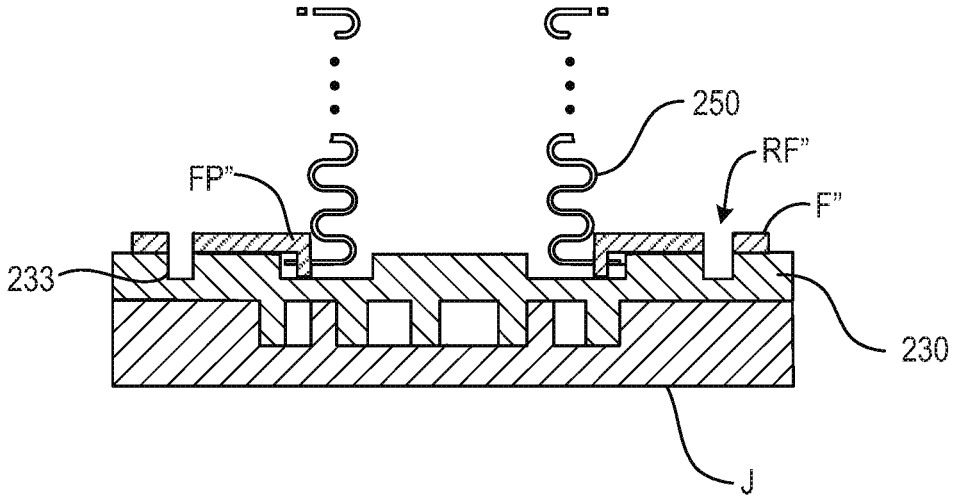

FIG. 3G shows an alternative version of the fixture that may be used to angularly align the bellows 250 and the orbiting plate scroll 230. In this example, the fixture F" has pins FP", and the first end 251 of the metallic bellows 250 is an annular flange having holes therein corresponding to the pins FP", respectively. The fixture F" is mounted to the assemblage by respectively inserting the pins FP" of the fixture F" into holes provided in the first end 251 of the metallic bellows 250. The reference features in this case may be openings RF" extending through the fixture F" and holes 233 in the back side 230B of the orbiting plate scroll 230. Thus, FIG. 3G shows the state of angular alignment between the bellows 250 and the orbiting plate scroll 230.

Instead of having openings RF", the fixture F" could have another set of pins that are received in the holes in the back side 230B of the orbiting plate scroll 230 when the two are angularly aligned. In this case, steps S30 and S40 could be essentially carried out at the same time.

Moreover, and although not shown, the fixture F" may have slots therein that allow individual clamping members of a clamp (C1) to be secured to the back side of the orbiting plate scroll 230 and tightened to fix the first end 251 of the bellows 250 to the orbiting plate scroll 230.

Next, and referring to FIGS. 2 and 3F, the fixture F (or F") is removed from the bellows (S60).

As should be clear, though, from the description above, the clamp C1 could be provided at this time and used to clamp the bellows 250 to the orbiting plate scroll 230. That is, the order of steps S50 and S60 could be reversed.

Subsequently, the resulting assemblage is fixed to the frame 210 (as shown in FIG. 1). More specifically, in this example, the second end 252 of the bellows 250 is fixed to the frame 210 with fasteners inserted through holes in the frame 210 into (corresponding through-holes 255 in) the second end 252 of the bellows 250. As a result, a predetermined angular alignment is provided between the orbiting scroll blade 231 and the frame 210. That is, these through-holes 255 in the second end 252 of the bellows 250 and the dedicated holes in the frame 210 constitute an angular alignment feature of the pump head as well.

Finally (S80), the stationary plate scroll 220 is fixed to the frame 210, as shown in FIG. 1, using dedicated fasteners and holes, so that a predetermined angular alignment is provided between the stationary plate scroll 210 and the frame 210. In this respect, as well, dedicated fasteners in one of the stationary plate scroll 210 and the frame 210 and holes in the other constitute an angular alignment feature of the pump head. Hence, a predetermined angular alignment is provided between the stationary scroll blade 221 and the frame 210.

As a result, the stationary and orbiting scroll blades 221 and 231 are angularly synchronized.

A second embodiment of a method of assembling the pump head assembly will now be described with reference to FIGS. 1, 4 and 5A-5F.

First, respective components of the eccentric drive mechanism 240 are assembled to the frame 210 and the orbiting plate scroll 230. However, these components are not shown in FIG. 5A for the sake of simplicity. Also, the metallic bellows 250 is fastened at the first end 251 thereof to the orbiting plate scroll 230 (S100). The fasteners used to this end are such that a predetermined angular alignment between the bellows 250 and the orbiting plate scroll 230 is established. The fasteners thus constitute an angular alignment feature of the pump head. Then, the second end 252 of the bellows 250 is set against the frame 210 (S200). Note, in FIG. 5A, the frame 210 is shown in a simplified form.

Furthermore, in an example of this embodiment, the first and second ends 251 and 252 are annular flanges having through-holes extending axially therethrough for receiving fasteners that fix the ends 251 and 252 to the orbiting plate scroll 230 and the frame 210, respectively. Also, the front side 230F of the orbiting plate scroll 230 has, in this example, pin holes PH extending therein.

Figure 5A:
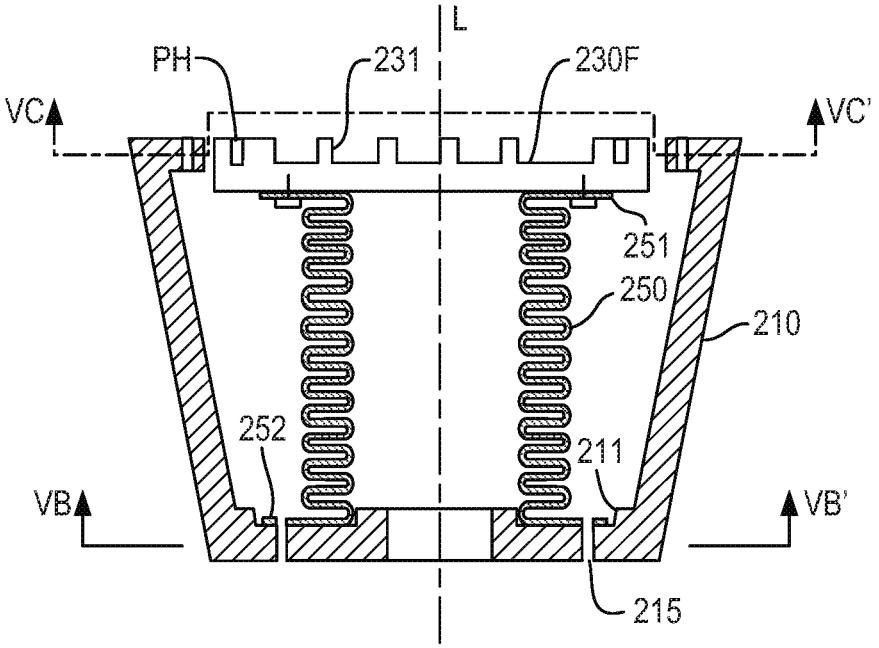
Figure 5B:
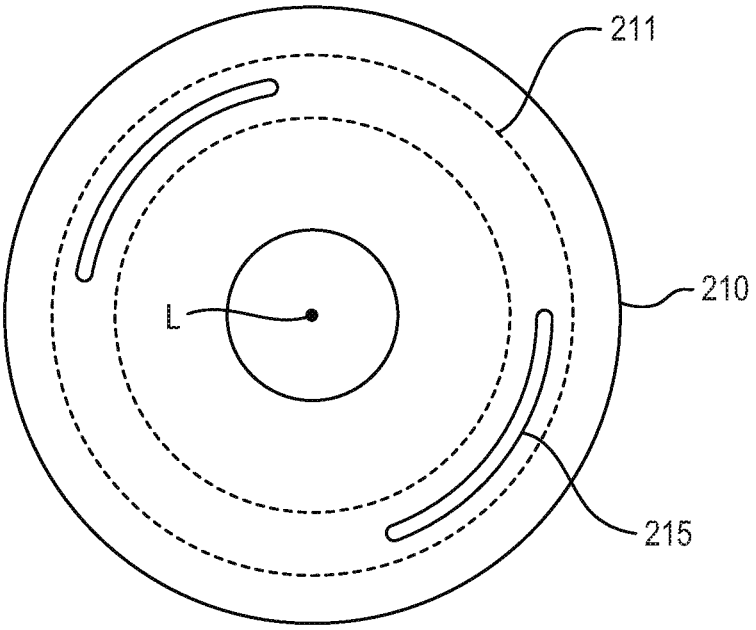
Figure 5C:
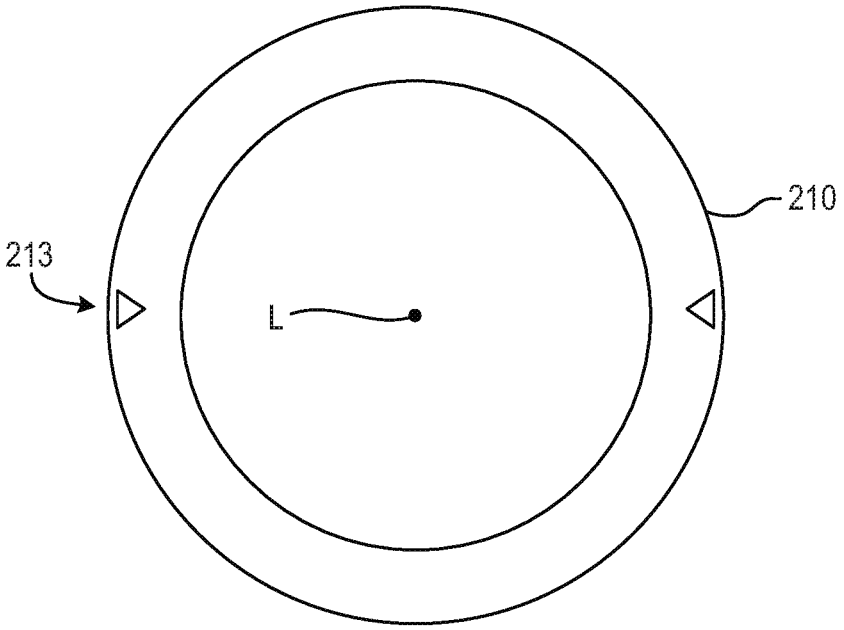

Furthermore, as shown in FIG. 5B, the frame 210 has arcuate slots 215. The slots 215 have radii of curvature emanating from a central axis through which the longitudinal axis L passes. In addition, as shown in FIG. 5C, the frame 210 has a reference feature 213. Preferably, the reference feature 213 is a precision-machined feature. For example, the reference feature 213 is a pair of bores drilled into the frame 210 as represented by the arrowheads in FIG. 5C.

Figure 4:
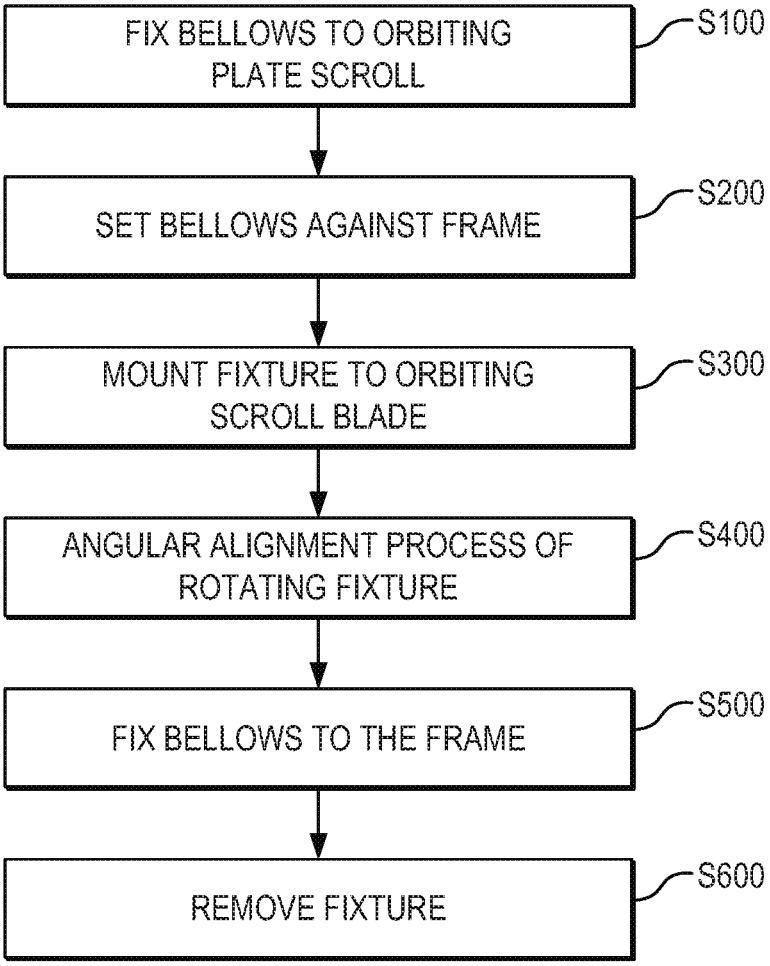
FIG. 4 is a flow chart illustrating a second embodiment of a method of assembling respective parts of the pump head of a scroll pump according to the present invention.
Figure 5D:
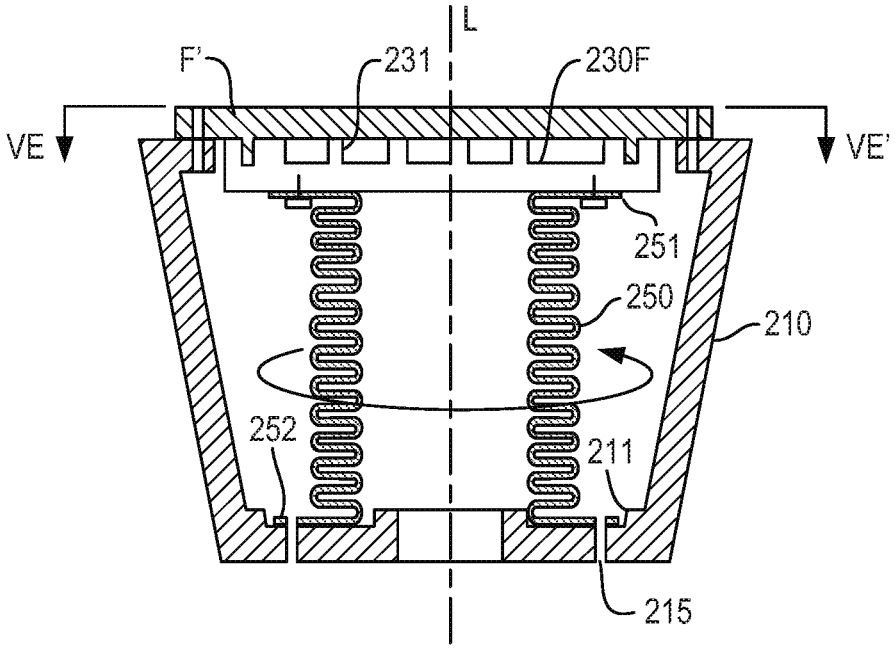
Figure 5E:
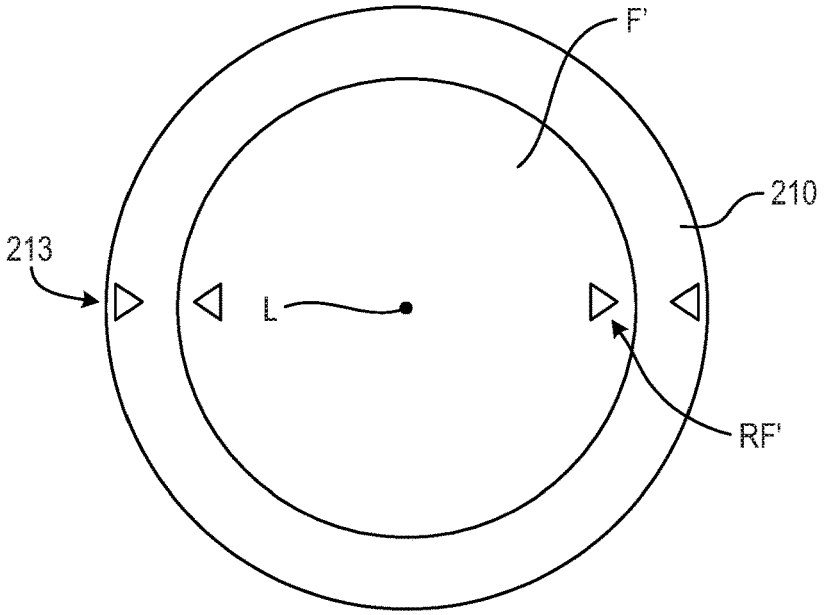
Figure 5F:
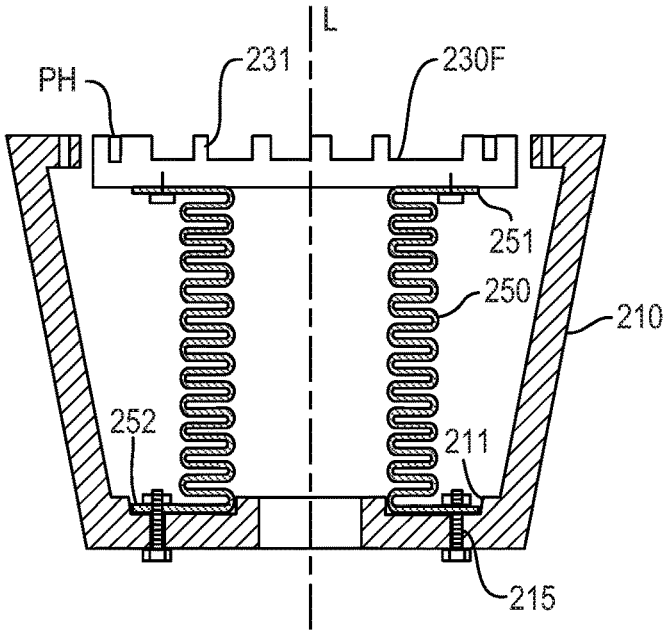

Next, and referring to FIGS. 4 and 5D, a fixture F' is mounted to the orbiting plate scroll 230 (S300). In this example, the fixture F' has pins that correspond to and are received in the pin holes PH (FIG. 5A) in the front side of the orbiting plate scroll 230. The fixture F' also has a reference feature RF' (FIG. 5E). The reference feature RF' is preferably a precision-machined feature such as a pair of bores corresponding to those in the front side 230F of the orbiting plate scroll.

Next, and referring to FIGS. 5D and 5E, an angular alignment process (S400) is performed. The angular alignment process (as represented by the arrow in FIG. 5D) comprises rotating the assemblage of the bellows 250, the orbiting plate scroll 230 fixed to the bellows 250, and the fixture F' mounted to the orbiting plate scroll, about the longitudinal axis L relative to the frame 210 until the reference feature RF' of the fixture F' is aligned with the reference feature 213 provided on the frame 210 (as represented by the aligned arrowheads in FIG. 5E). In an example of this embodiment, the angular alignment process may comprise rotating the fixture F' until the bores extending therethrough align in the axial direction with bores in the frame 210 (as shown in FIG. 5D).

Furthermore, the second end 252 of the bellows 250 may be seated in a circular recess 211 in the frame 210 to guide the assemblage during its rotation about the longitudinal axis L. Alternatively, the fixture F' may be circular and may be seated in a circular recess in the frame 210 to guide the assemblage during its rotation about the longitudinal axis L.

In any case, as a result of the angular alignment process (S400), the orbiting scroll blade 231 assumes a predetermined angular alignment with respect to the frame 210. For example, the orbiting scroll blade 231 assumes a predetermined angular alignment with respect to the bores constituting the reference feature RF' of the frame 210.

In this example, fasteners are inserted through the through-holes in the second end 252 of the bellows 250 and through the arcuate slots 215 in the frame 210 to clamp the second end 252 of the bellows 250 to the frame 210 with the predetermined angular alignment established between the orbiting scroll blade 231 and the frame 210.

Then the second end 252 of the bellows is fastened to the frame 210 (S500). Next, and referring to FIGS. 4 and 5F, the fixture F' is removed (S600). Alternatively, the fixture F' may in some cases be removed before the second end 252 of the bellows is fastened to the frame 210.

Subsequently, and referring to FIGS. 1 and 2, the stationary plate scroll 220 is then fastened to the frame 210 with a predetermined angular alignment therebetween. In this example, the stationary plate scroll 220 is provided with through-holes corresponding to the bores constituting the reference feature 213 of the frame 210. Fasteners are inserted into through-holes in the stationary plate scroll 230 and are received in the bores to clamp the stationary plate scroll 220 to the frame 210. As a result, the stationary and orbiting scroll blades 221 and 231 are angularly synchronized.

As described above, a pump head of a scroll pump according to the present invention includes a frame, an orbiting plate scroll having an orbiting scroll blade, an eccentric driving mechanism supported by the frame and to which the orbiting plate scroll is coupled, a stationary plate scroll fixed to the frame and having a stationary scroll blade nested with the orbiting scroll blade, an annular metallic bellows having first and second ends, fasteners that fix the bellows at the first end thereof to orbiting plate scroll, the bellows at the second end thereof to the frame, and the stationary plate scroll to the frame, and in which one of the orbiting plate scroll and the frame has a curved mounting feature and a reference feature. The curved mounting feature is juxtaposed in the axial direction of the pump head with one of the flanges of the bellows and facilitates an angular positioning of the bellows in an assemblage during the course of the assembly process. To this end, the curved feature has a radius of curvature radiating from a central longitudinal axis of the pump head. The reference means is a reference feature, such as a precision-machined feature, that is used to synchronize the stationary and orbiting scroll blades in the assembly process.

The curved mounting feature may be a circular recess in the back side of the orbiting plate scroll. In this case, the circular recess has an outer diameter that is substantially the same as that of an annular flange constituting the first end of the bellows, and the annular flange is disposed in the circular recess so as to be seated in the back side of the orbiting plate scroll. The orbiting plate scroll is provided with the reference feature.

The reference feature may be a set of through-holes extending axially through the plate scroll and which receive respective ones of the fasteners to fix the bellows, at the first end thereof, to the orbiting plate scroll.

Alternatively, the curved mounting feature may be a set of arcuate slots extending through the frame, and through which respective ones of the fasteners extend to fix the bellows, at the second end thereof to the frame. In this case, the frame has the reference feature. The reference feature may be a set of through-holes in the frame and which receive respective ones of the fasteners to fix the stationary plate scroll to the frame.

Accordingly, the design of the pump head, and especially the use of the metallic bellows as a primary means of setting the relative angular position of the orbiting plate scroll in the pump head, facilitates an assembly process in which the stationary and orbiting scroll blades can be positioned so as to be angularly synchronized. In particular, the design of the pump head is such that a simple appliance (e.g., a single fixture or a jig and a single fixture) can be readily adapted for use in the assembly process, and the assembly process does not require a great deal of skill or visual acuity.

In addition, according to aspects of the present invention described above, a pump head of a scroll pump—having a bellows for angularly synchronizing the scroll blades of an orbiting plate scroll and a stationary plate scroll of the pump head and/or for sealing off elements of an eccentric drive mechanism from a working chamber in the pump head—can be assembled according to any of the following schemes.

Figure 6:
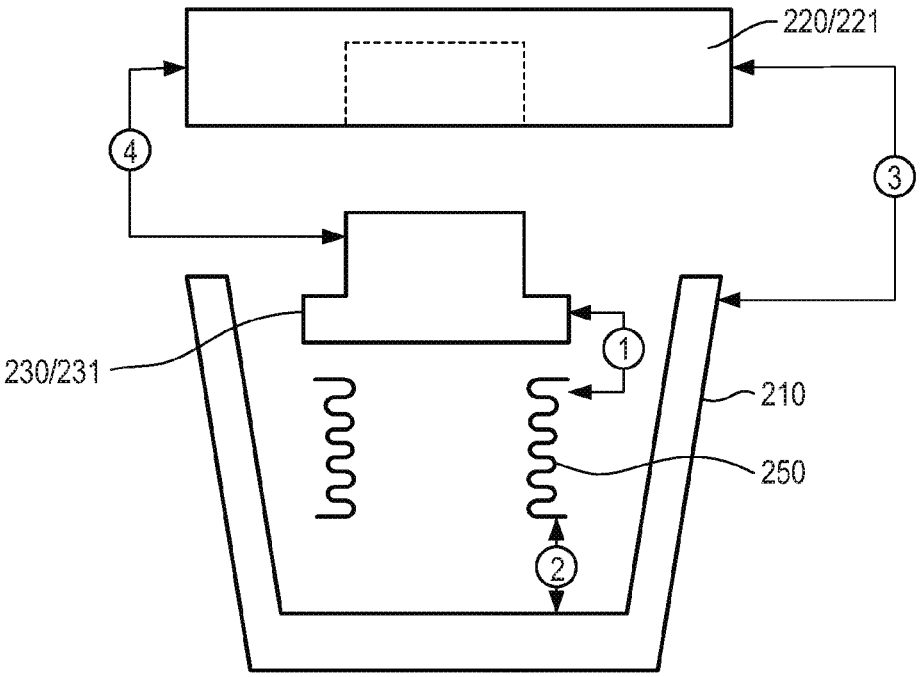
FIG. 6 is a conceptual drawing illustrating one scheme of assembling respective parts of the pump head assembly according to the present invention.

Referring to FIG. 6, and as was described above with respect to the flow chart of FIG. 2, in a method according to the present invention, angular relationship (1) between the orbiting plate scroll 230 and the bellows 250 is established by a removable fixture; angular relationship (2) is established by an angular alignment feature of the bellows 250 and the frame 210 (for example, a pin or fastener and pin/fastener-receiving opening); and angular relationship (3) is established by an angular alignment feature of the frame 210 and the stationary plate scroll 220 (for example, a pin or fastener and pin/fastener-receiving opening). As a result, angular relationship (4) is established between the orbiting scroll blade 231 and the stationary scroll blade 221.

Still referring to FIG. 6, another alignment scheme is as follows: angular relationship (1) between orbiting plate scroll 230 and bellows 250 is established using an angular alignment feature of the bellows 250 and the orbiting plate scroll 230 (for example, a pin or fastener and pin/fastener-receiving opening), i.e., without using a fixture; angular relationship (2) between the bellows 250 and the frame 210 is established by a removable fixture used to align; and angular relationship (3) is established by an angular alignment feature of the frame 210 and the stationary plate scroll 220 (for example, a pin or fastener and pin/fastener-receiving opening). As a result, angular relationship (4) between the orbiting scroll blade 231 and the stationary scroll blade 221 is established.

Figure 7:
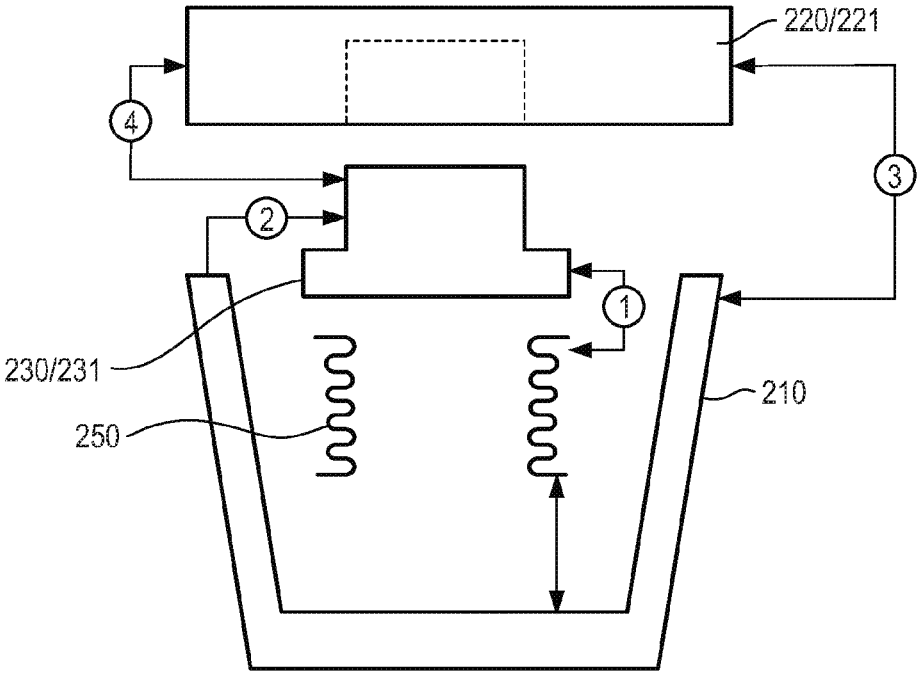
FIG. 7 is a conceptual drawing illustrating another scheme of assembling respective parts of the pump head assembly according to the present invention.

Referring to FIG. 7, as was described above with respect to the flow chart of FIG. 4, in a method according to the present invention, there is no need to provide any predetermined angular relationship between bellows 250 and frame 210. Instead, angular relationship (1) between orbiting plate scroll 230 and bellows 250 is established using an angular alignment feature of the bellows 250 and the orbiting plate scroll 230 (for example, a pin or fastener and pin/fastener-receiving opening); angular relationship (2) between the orbiting plate scroll 230 and the frame 210 is established using a removable fixture; and angular relationship (3) is established by an angular alignment feature of the frame 210 and the stationary plate scroll 220 (for example, a pin or fastener and a pin/fastener-receiving opening). As a result of establishing the angular relationships (1), (2) and (3), predetermined angular relationship (4) between the orbiting scroll blade 231 and the stationary scroll blade 221 is established.

Figure 8:
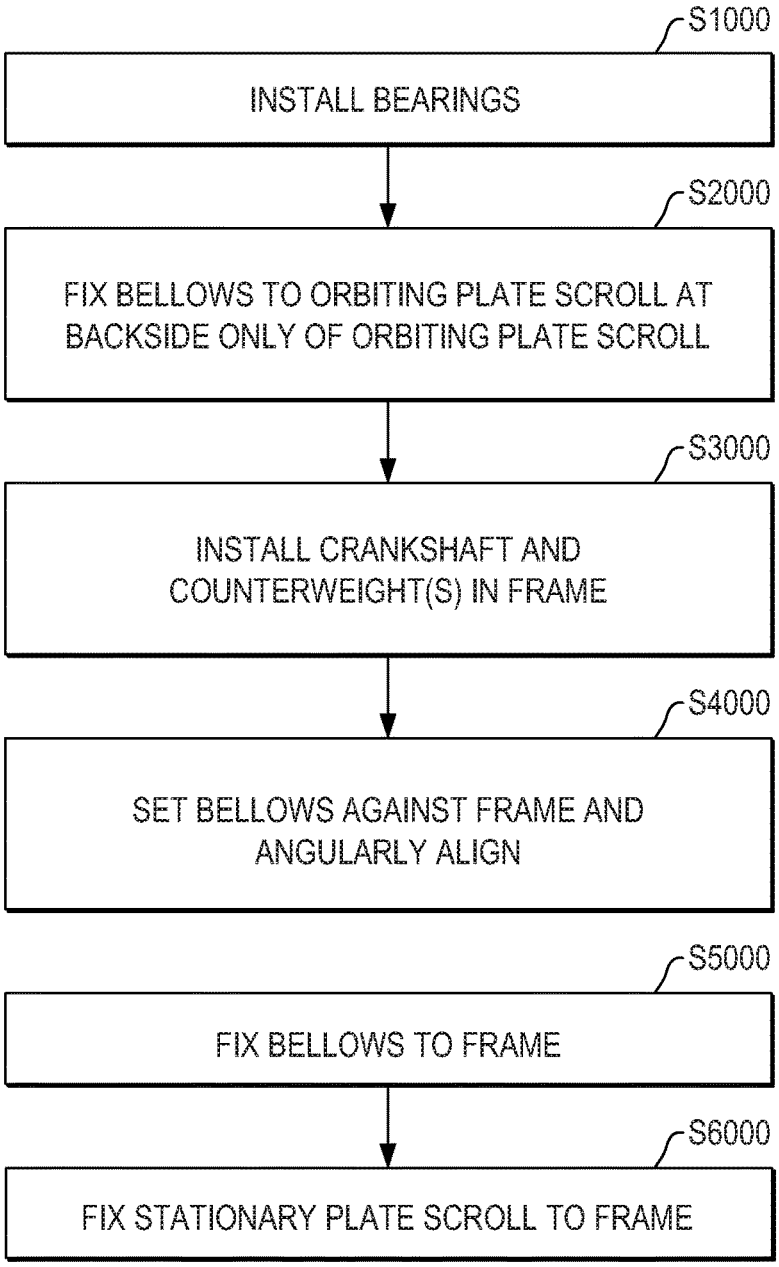
FIG. 8 is a flow chart illustrating another embodiment of a method of assembling respective parts of the pump head assembly according to the present invention.

Another embodiment of a scroll pump, and a method of assembling parts of the scroll pump, according to the present invention, will now be described with reference to FIGS. 8-10.

Figure 9:
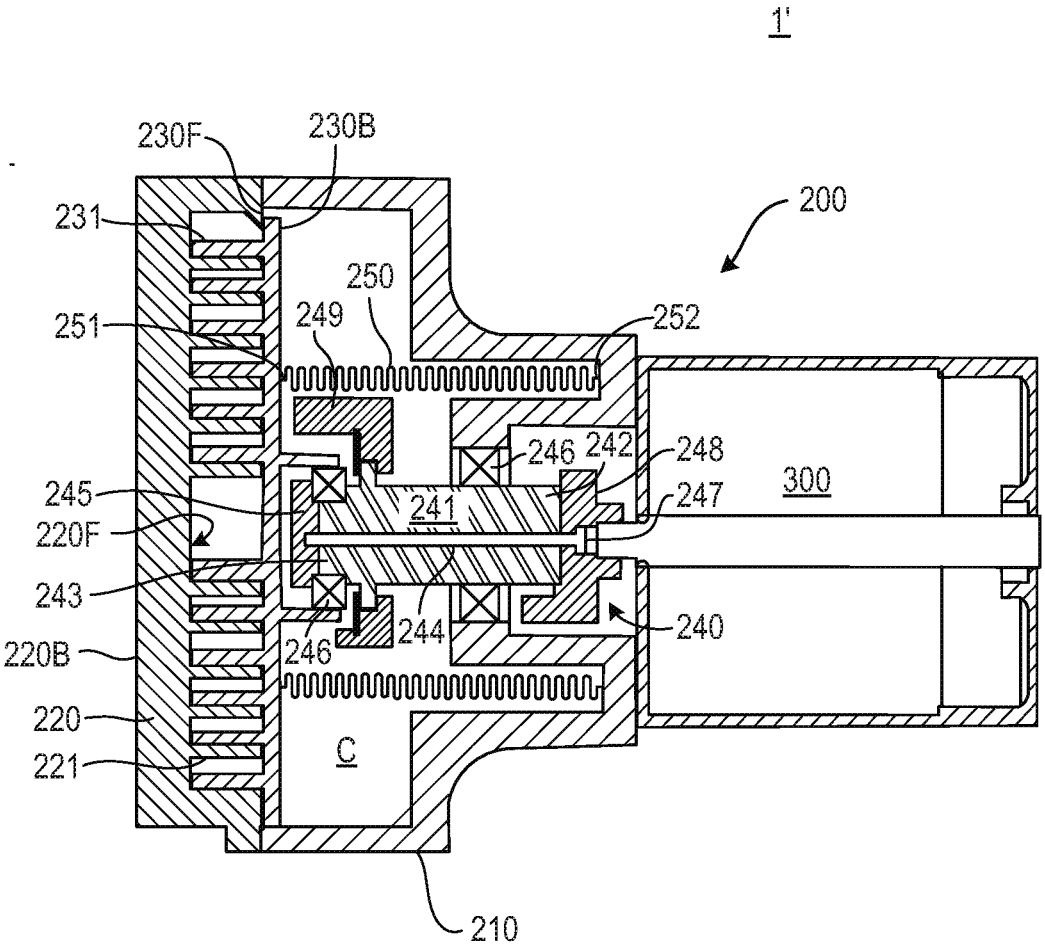
FIG. 9 is a schematic longitudinal sectional view of another version of a scroll pump to which the present invention is applied.

In FIG. 9, parts of the scroll pump 1' corresponding to those of the scroll pump 1 shown in and described with reference to FIG. 1 are designated by like reference numerals. In addition, the crank shaft 241 of the eccentric drive mechanism 240 of the pump head of the scroll pump 1' has a bore 244 extending axially therethrough as aligned with the central longitudinal axis of the crank 243. A bolt 247 extends through and is freely received in the bore 244. An end nut 245 is threaded to an end of the bolt 247 within a cylindrical boss of the orbiting scroll plate 230 that receives bearings 246. The eccentric drive mechanism 240 also has a rear counterweight 248 disposed on the end of the main portion 242 of the crank shaft 241 closest to the motor 300, and a front counterweight 249 disposed on the main portion 242 of the crank shaft 241 adjacent the crank 243.

A method of assembling the parts of the scroll pump 1' will now be described in detail with additional reference to FIG. 8.

First, bearings 246 are mounted to the frame 210 and to the orbiting plate scroll 230 within bosses thereof, respectively (S1000). During this step, the end nut 245 is placed in the boss of the orbiting plate scroll 230 as engaged with the bearings 246 mounted to the orbiting plate scroll 230 so as to be supported by the bearings 246 between the bearings 246 and the plate of the orbiting plate scroll 230.

Next, the bellows 250 is fixed, at the first end 251 thereof, to the orbiting plate scroll 230 (S2000). In this respect, any of the techniques described above with reference to the embodiment of FIGS. 2 and 4 may be employed. That is, a fixture may be employed to angularly align the bellows 250 and the orbiting plate scroll 230 (refer to the descriptions of FIGS. 2 and 3A-3G), and the first end 251 (annular flange) of the bellows 250 is fastened to the orbiting plate scroll 230 (using a clamp C1). Alternatively, fasteners can be inserted in through-holes in the first end 251 (annular flange) of the bellows 250 and into dedicated holes in the back side 230B of the orbiting plate scroll 230 (refer to the descriptions of step S100 in the embodiment of FIG. 4 and FIG. 5A).

In either case, however, the fasteners used to secure the first end 251 of the bellows 250 to the orbiting plate scroll 230 may comprise threaded fasteners directed into the orbiting plate scroll 230 through threaded openings open only at the back side 230B of the orbiting plate scroll 230, i.e., they do not open at the front side 230F of the orbiting plate scroll 230. That is, according to an aspect of the present invention, the openings into which the fasteners are inserted are blind holes open at the back side 230B of the orbiting plate scroll 230.

Figure 10:
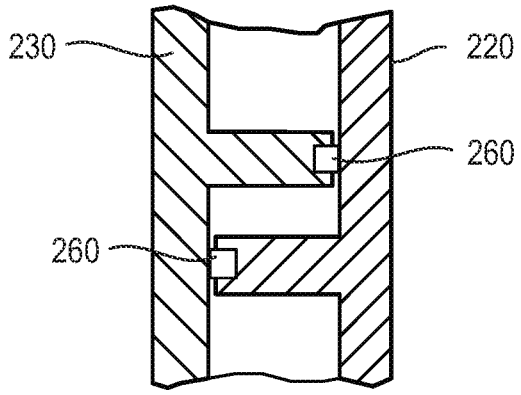
FIG. 10 is a sectional view of part of the pump head of the scroll pump shown in FIG. 9, illustrating tip seals between the stationary plate scroll and the orbiting plate scroll.

As shown in FIG. 10, the scroll pump 1' has tip seals 260 each seated in a groove extending in and along the length of the tip (axial end) of a respective one of the scroll blades (the groove thus also having the form of the scroll). Each tip seal 260 is a plastic member interposed between the tip of the scroll blade (221, 231 in FIG. 9) of one of the stationary and orbiting plate scrolls 220, 230, and the plate of the other of the stationary and orbiting plate scrolls 220, 230. The tip seals 260 serve to maintain the pocket(s) between the nested scroll blades 221, 231 as the orbiting plate scroll 230 is driven relative to the stationary plate scroll 220. The blind holes in the back side 230B of the orbiting plate scroll 230, which receive the fasteners for fastening the first end 251 of the bellows 250 to the orbiting plate scroll 230, do not interrupt the tip-seal receiving surface of the plate of the orbiting plate scroll 230. This is in contrast to a conventional technique in which fasteners are inserted through the tip-seal receiving surface of the orbiting scroll plate to fix a bellows to the orbiting plate scroll. Accordingly, the life of the tip seal 260 seated in the tip of the scroll blade 221 of the stationary plate scroll 220 is prolonged by this aspect of the present invention.

Referring again to FIG. 8, next, a crank shaft and counterweight assembly is installed in the frame 210 (S3000). For example, with reference to FIG. 9, the counterweights 248, 249 are mounted to the crank shaft 241, and the resulting assembly is installed in the frame 210 (as secured to the bearings 246 already installed in the boss of the frame 210). For example, the rear counterweight 248 can be press-fitted to the end of the crank shaft 241 that is to be disposed closest to the motor, and a beveled snap ring can be used to clip the front counterweight 249 to a shoulder of the crank shaft 241 (formed by an annular flange) as shown in FIG. 9. Alternatively, the crank shaft and counterweight assembly may be a one-piece member comprising a counterweight(s) and crank shaft that are unitary, and this one-piece member is installed in the frame 210.

Next, the assembly comprising the bellows 250, orbiting plate scroll 230, end nut 245 and bearings 246 mounted to the orbiting plate scroll 230 is positioned relative to the frame 210 and the crank shaft and counterweight assembly such that the second end 252 of the bellows 250 is set against the frame 210 (S4000). At this time, if the technique of FIG. 4 is being used, the bellows 250 is rotated relative to the frame 210 until the reference features of the frame 210 and fixture F' are aligned (FIG. 5D). Alternatively, the bellows 250 is rotated relative to the frame 210 until dedicated holes in the frame 210 are aligned with holes in the annular flange constituting the second end 252 of the bellows 250, as in the technique of the embodiment of FIG. 2. In either case, the result is a predetermined angular alignment between the orbiting plate scroll 230 and the frame 210 to which the stationary plate scroll 220 will be attached.

Then, in this state of alignment, the bellows 250 is fixed at its second end 252 to the frame 210 (S5000). According to an aspect of the present invention, the fasteners used to secure the second end 252 (annular flange) of the bellows 250 to the frame 210 are inserted into the frame 210 from the outer side thereof, i.e., from the outer surface of the frame 210 that will face the motor 300. Threads, such as the internal threads of nuts, integral with the second end 252 (annular flange) of the bellows 250 can allow the bellows 250 to be fixed at its second end 252 to the frame 210 without the need to access the interior space defined by and between the frame 210 and orbiting plate scroll 230.

Next, the bolt 247 is inserted into the bore 244, through the crank shaft and counterweight assembly, and into engagement with the end nut 245, and is rotated (tightened). In this example, the bearings 246 supporting the orbiting plate scroll 230 are interposed between the end nut 245 and a shoulder in the crank 243. Also, the head of the bolt 245 bears against the rear counterweight 248. Accordingly, tightening the bolt 247 forces the end nut 245 towards the crank 243 and thereby pre-loads the bearings 246 mounted to the orbiting plate scroll 230. This contrasts with a conventional technique of screwing the end nut to the crank by accessing the end nut through the tip seal-receiving surface of the plate of the orbiting plate scroll, inserting a threaded fastener through the end nut and into the crank, and then tightening the screw to force the end nut towards the crank. Thus, the life of the tip seal 260 is also prolonged because the tip-seal receiving surface of the plate of the orbiting plate scroll 230 requires no access opening to access the end nut 245.

Figure 11:
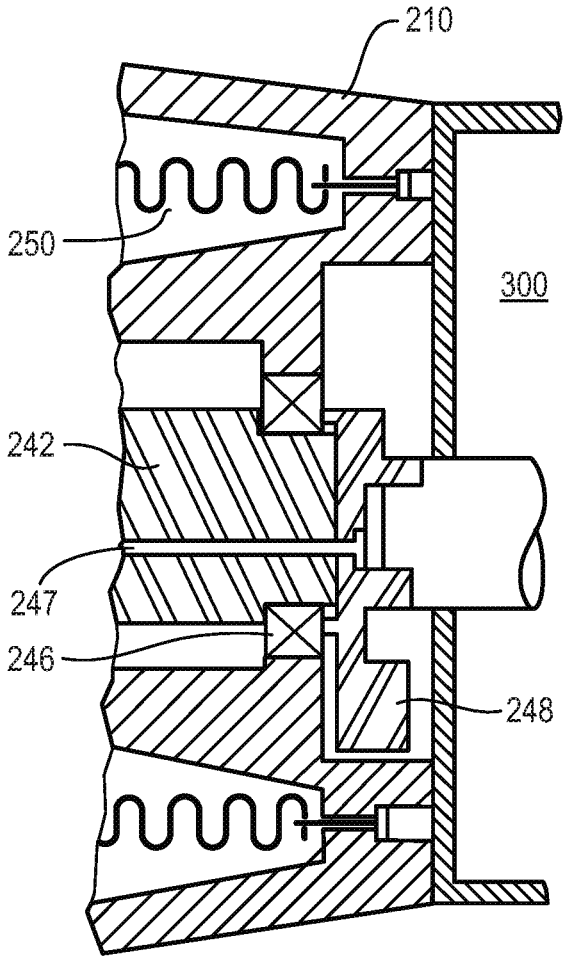
FIG. 11 is an enlarged schematic longitudinal sectional view of part of another version of a scroll pump according to the present invention.

FIG. 11 schematically shows an arrangement by which the bearings 246 between the frame 210 and main portion 242 of the crank shaft 241 can also be pre-loaded by tightening the bolt 247. In this arrangement, bearings 246 are interposed between a shoulder of the main portion 242 of the crank shaft 241 and the rear counterweight 248. Accordingly, tightening the bolt 247 to force the end nut 245 and the rear counterweight 248 (FIG. 9) towards each other can also pre-load these bearings 246.

Then, the tip seals 260 are installed, and the stationary plate scroll 220 is fastened to the frame 210 (S6000).

Finally, embodiments of the inventive concept and examples thereof have been described above in detail. The inventive concept may, however, be embodied in many different forms and should not be construed as being limited to the embodiments described above. Rather, these embodiments were described so that this disclosure is thorough and complete, and fully conveys the inventive concept to those skilled in the art. Thus, the true spirit and scope of the inventive concept is not limited by the embodiment and examples described above but by the following claims.

What is claimed is:

1. A method of assembling parts of a pump head of a scroll pump, the method comprising:

placing a first end of a metallic bellows against a back side of an orbiting plate scroll having an orbiting scroll blade at its front side;

placing a second end of the metallic bellows against a frame;

mounting a fixture, having a reference feature, to an assemblage comprising the metallic bellows and the orbiting plate scroll;

performing an angular alignment process, comprising rotating the metallic bellows, with the fixture mounted to the assemblage, until the reference feature of the fixture aligns in the circumferential direction of the metallic bellows with another reference feature provided on one of the orbiting plate scroll and the frame;

fixing the metallic bellows, at the first end thereof, to the orbiting plate scroll;

removing the fixture from the assemblage after the angular alignment process has been performed;

fixing the metallic bellows, at the second end thereof, to the frame; and subsequently fixing a stationary plate scroll, having a stationary scroll blade, to the frame in a predetermined angular alignment with the frame and such that the stationary scroll blade faces the orbiting scroll blade in a radial direction, wherein the fixing of the metallic bellows to the orbiting plate scroll and to the frame at the first end and the second end of the metallic bellows, respectively, and the fastening of the stationary plate scroll to the frame angularly synchronizes the stationary scroll blade and the orbiting scroll blade with one another.

2. The method of claim 1, further comprising setting the orbiting plate scroll on a jig, that prevents the orbiting plate scroll from rotating about its central longitudinal axis, with the back side of the orbiting plate scroll facing up, and the reference feature of the orbiting plate scroll exposed, and wherein the another reference feature is provided on the orbiting plate scroll, the first end of the metallic bellows is placed against the back side of the orbiting plate scroll while the orbiting plate scroll is set on the jig, the fixture is mounted to the assemblage by mating respective portions of the fixture and the second end of the metallic bellows with one another such that the fixture is mounted to the metallic bellows with a predetermined angular alignment therewith, the angular alignment process comprises rotating the fixture mounted to the metallic bellows relative the orbiting plate scroll against which the first end of the metallic bellows has been set, while the orbiting plate scroll is set on the jig, until the reference feature of the fixture aligns, in the circumferential direction of the metallic bellows, with the reference fixture of the orbiting plate scroll, the metallic bellows is fixed, at the first end thereof, to the orbiting plate scroll by clamping the first end of the metallic bellows to the orbiting plate scroll, and the metallic bellows is fixed, at the second end thereof, to the frame after the metallic bellows has been fixed to the orbiting plate scroll.

3. The method of claim 2, wherein the placing of the first end of the metallic bellows against the back side of an orbiting plate scroll comprises inserting an annular flange of the metallic bellows into a complementary circular recess in the back side of the orbiting plate scroll.

4. The method of claim 3, wherein the fixture is mounted to the assemblage by respectively inserting pins of the fixture into holes provided in the second end of the metallic bellows.

5. The method of claim 4, wherein the fixing of the metallic bellows, at the second end thereof, to the frame comprises inserting fasteners through said holes provided in the second end of the metallic bellows.

6. The method of claim 2, wherein the fixture is mounted to the assemblage by respectively inserting pins of the fixture into holes provided in one of the ends of the metallic bellows.

7. The method of claim 6, wherein the fixing of the metallic bellows, at the second end thereof, to the frame comprises inserting fasteners through said holes provided in the second end of the metallic bellows.

8. The method of claim 1, wherein the another reference feature is provided on the frame, the metallic bellows is fixed, at the first end thereof, to the orbiting plate scroll before the angular alignment process is performed, the second end of the metallic bellows is set against the frame while the orbiting plate scroll is fixed to the metallic bellows at the first end thereof, the fixture is mounted to the assemblage by mating respective portions of the fixture and the orbiting plate scroll with one another such that the fixture is mounted to the orbiting plate scroll with a predetermined angular alignment therewith, the angular alignment process comprises rotating an assemblage, comprising the metallic bellows, the orbiting plate scroll fixed to the metallic bellows, and the fixture mounted to the orbiting plate scroll, relative to the frame until the reference feature of the fixture is aligned with the reference feature provided on the frame, and the metallic bellows is fixed, at the second end thereof, to the frame after the angular alignment process has been performed.

9. The method of claim 8, wherein the fixture is mounted to the assemblage by mating a portion of the fixture with a portion of the orbiting scroll blade.

10. The method of claim 8, wherein said mating comprises respectively inserting pins of the fixture into holes in the orbiting scroll blade.

11. The method of claim 8, wherein the fixing of the metallic bellows, at the second end thereof, to the frame comprises respectively inserting fasteners through arcuate slots in the frame, the arcuate slots having radii of curvature emanating from a central axis that coincides with an axis about which the assemblage is rotated during the angular alignment process.

* * * * *